US009487006B2

(12) United States Patent
Kakiuchi et al.

(10) Patent No.: US 9,487,006 B2
(45) Date of Patent: Nov. 8, 2016

(54) LIQUID DROPLET JETTING APPARATUS AND METHOD FOR MANUFACTURING LIQUID DROPLET JETTING APPARATUS

(71) Applicant: Brother Kogyo Kabushiki Kaisha, Nagoya-shi, Aichi-Ken (JP)

(72) Inventors: Toru Kakiuchi, Aichi-ken (JP); Atsushi Ito, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/490,795

(22) Filed: Sep. 19, 2014

(65) Prior Publication Data

US 2015/0091983 A1 Apr. 2, 2015

(30) Foreign Application Priority Data

Sep. 30, 2013 (JP) ..... 2013-203439

(51) Int. Cl.

| | |
|---|---|
| ***B41J 2/015*** | (2006.01) |
| ***B41J 2/045*** | (2006.01) |
| ***B41J 2/14*** | (2006.01) |
| ***B41J 2/16*** | (2006.01) |

(52) U.S. Cl.

CPC ..... *B41J 2/14274* (2013.01); *B41J 2/14233* (2013.01); *B41J 2/161* (2013.01); *B41J 2/1612* (2013.01); *B41J 2/1623* (2013.01); *B41J 2/1626* (2013.01); *B41J 2/1631* (2013.01); *B41J 2/1645* (2013.01); *B41J 2/1646* (2013.01); *B41J 2002/14241* (2013.01); *Y10T 29/42* (2015.01)

(58) Field of Classification Search

None

See application file for complete search history.

(56) References Cited

U.S. PATENT DOCUMENTS

| | | | |
|---|---|---|---|
| 6,616,270 | B1 | 9/2003 | Miyata et al. |
| 2003/0206218 | A1 | 11/2003 | Miyata et al. |
| 2004/0134881 | A1 | 7/2004 | Shimada et al. |
| 2005/0185025 | A1 | 8/2005 | Shimada et al. |

(Continued)

FOREIGN PATENT DOCUMENTS

| | | |
|---|---|---|
| JP | 2002-264331 | 9/2002 |
| JP | 3422364 | 6/2003 |

(Continued)

OTHER PUBLICATIONS

Extended European Search Report of EP Application No. 14184496.9 dated May 29, 2015.

(Continued)

*Primary Examiner* — Erica Lin

(74) *Attorney, Agent, or Firm* — Frommer Lawrence & Haug LLP

(57) ABSTRACT

A liquid droplet jetting apparatus includes: a nozzle plate formed with a nozzle; a first flow passage formation body stacked on the nozzle plate and formed with a liquid flow passage including a pressure chamber in communication with the nozzle; a piezoelectric element arranged on a surface of the first flow passage formation body on the side opposite to the nozzle plate and configured to apply a pressure to a liquid in the pressure chamber; and a second flow passage formation body arranged on the side opposite to the nozzle plate with respect to the first flow passage formation body so as not to hinder driving of the piezoelectric element. The second flow passage formation body is formed with a liquid storing chamber and a throttle flow passage configured to restrict an amount of the liquid flowing from the liquid storing chamber into the pressure chamber.

7 Claims, 13 Drawing Sheets

(56) References Cited

U.S. PATENT DOCUMENTS

| | | | | |
|---|---|---|---|---|
| 2006/0066676 | A1* | 3/2006 | Sanada | 347/50 |
| 2006/0209139 | A1 | 9/2006 | Murata | |
| 2008/0084457 | A1* | 4/2008 | Hibi et al. | 347/70 |
| 2008/0151008 | A1 | 6/2008 | Fukugawa et al. | |
| 2008/0180490 | A1 | 7/2008 | Murata | |

FOREIGN PATENT DOCUMENTS

| | | |
|---|---|---|
| JP | 2006-102980 | 4/2006 |
| JP | 3783781 | 6/2006 |
| JP | 3852560 | 11/2006 |
| JP | 2008-044218 | 2/2008 |
| WO | WO 2013/079369 | 6/2013 |

OTHER PUBLICATIONS

Notification of First Office Action issued for Chinese Patent Application No. 201410460629.4 dated Oct. 21, 2015.

Notification of Second Office Action issued for Chinese Patent Application No. 201410460629.4 dated Jul. 11, 2016.

* cited by examiner

LIQUID DROPLET JETTING APPARATUS AND METHOD FOR MANUFACTURING LIQUID DROPLET JETTING APPARATUS

CROSS REFERENCE TO RELATED APPLICATION

The present application claims priority from Japanese Patent Application No. 2013-203439, filed on Sep. 30, 2013, the disclosure of which is incorporated herein by reference in its entirety.

BACKGROUND OF THE INVENTION

1. Field of the Invention

The present invention relates to a liquid droplet jetting apparatus which is configured to jet liquid droplets from nozzles, and a method for manufacturing the liquid droplet jetting apparatuses.

2. Description of the Related Art

In a conventional ink-jet type recording head, a flow passage formation substrate is provided with pressure chambers in communication with nozzles, ink supply passages for supplying ink to the pressure chambers while restricting the amount of ink flowing into the pressure chambers, and a communicating portion for communicating the ink supply passages with a reservoir portion.

SUMMARY OF THE INVENTION

In such a conventional ink-jet type recording head, the pressure chambers and the ink supply passages are arranged in one direction parallel to a planar direction of the flow passage formation substrate. Therefore, it is feared that the ink-jet type recording head grows in size in the one direction.

An object of the present teaching is to provide a liquid droplet jetting apparatus and a method for manufacturing the liquid droplet jetting apparatus capable of restraining a flow passage formation body, in which liquid flow passages including pressure chambers are formed, from growing in size in a direction parallel to a planar direction of the flow passage formation body.

According to a first aspect of the present teaching, there is provided a liquid droplet jetting apparatus including: a nozzle plate formed with a nozzle; a first flow passage formation body stacked on the nozzle plate, formed with a liquid flow passage including a pressure chamber configured to communicate with the nozzle, and extending in a predetermined planar direction; a piezoelectric element arranged on a surface of the first flow passage formation body on a side opposite to the nozzle plate, and configured to apply a pressure to a liquid in the pressure chamber; and a second flow passage formation body arranged on the side opposite to the nozzle plate with respect to the first flow passage formation body so as not to hinder driving of the piezoelectric element, wherein the second flow passage formation body is formed with a liquid storing chamber configured to store the liquid, and a throttle flow passage arranged between the pressure chamber and the liquid storing chamber and configured to connect the pressure chamber and the liquid storing chamber and to restrict an amount of the liquid flowing from the liquid storing chamber into the pressure chamber, with respect to a direction orthogonal to the predetermined planar direction, the nozzle, the pressure chamber, the throttle flow passage, and the liquid storing chamber are arranged in this order, and the throttle flow passage overlaps with the pressure chamber when viewed from the direction orthogonal to the predetermined planar direction.

According to a second aspect of the present teaching, there is provided a method for manufacturing a liquid droplet jetting apparatus including: a nozzle plate formed with a nozzle; a first flow passage formation body stacked on the nozzle plate and formed with a liquid flow passage including a pressure chamber configured to communicate with the nozzle; a piezoelectric element arranged on a surface of the first flow passage formation body on a side opposite to the nozzle plate, and configured to apply a pressure to a liquid in the pressure chamber; and a second flow passage formation body arranged on the side opposite to the nozzle plate with respect to the first flow passage formation body, wherein the second flow passage formation body includes: a resin layer arranged on the side opposite to the nozzle plate with respect to the first flow passage formation body, and formed with a throttle flow passage configured to communicate with the pressure chamber; and a storing chamber formation member arranged on a surface of the resin layer on a side opposite to the first flow passage formation body, and formed with a liquid storing chamber configured to communicate with the throttle flow passage, the method including: a piezoelectric element formation step for forming the piezoelectric element on a substrate which is to be the first flow passage formation body; a resist layer formation step for forming a resist layer, which contains a photosensitive resin material and which is to be the resin layer, on the substrate formed with the piezoelectric element; an exposure step for forming, in the resist layer, an irradiated portion irradiated with a light ray and an unirradiated portion not irradiated with the light ray by irradiating a part of the resist layer with the light ray; and a removal step for removing one of the irradiated portion and the unirradiated portion, wherein in the exposure step, the one of the irradiated portion and the unirradiated portion is formed at a first portion, of the resist layer, at which the throttle flow passage is formed, and the other of the irradiated portion and the unirradiated portion is formed at a second portion, of the resist layer, other than the first portion, and wherein in the removal step, the throttle flow passage is formed in the resist layer by removing the one of the irradiated portion and the unirradiated portion from the resist layer.

In the liquid droplet jetting apparatus according to the first aspect of the present teaching, the throttle flow passage is arranged to overlap with the pressure chamber when viewed from the direction orthogonal to the predetermined planar direction. Therefore, it is possible to reduce the length of the first flow passage formation body in the predetermined planar direction, as compared with a case in which the pressure chamber and the throttle flow passage are arranged along the predetermined planar direction. By virtue of this, it is possible to restrain the liquid droplet jetting apparatus from growing in size in the predetermined planar direction.

Further, in the method for manufacturing the liquid droplet jetting apparatus according to the second aspect of the present teaching, the throttle flow passage is formed in the resist layer by forming the resist layer containing the photosensitive resin, forming the one of the irradiated portion irradiated with the light ray and the unirradiated portion not irradiated with the light ray at the first portion, of the resist layer, at which the throttle flow passage is formed, and then removing the one of the irradiated portion and the unirradiated portion from the resist layer. By virtue of this, as compared with a case in which a member formed with the throttle flow passage is joined to the substrate, or the like, it is possible to improve the precision of positioning the throttle flow passage with respect to the pressure chamber.

DESCRIPTION OF THE PREFERRED EMBODIMENT

Hereinbelow, a preferred embodiment of the present teaching will be explained.

Figure 1:
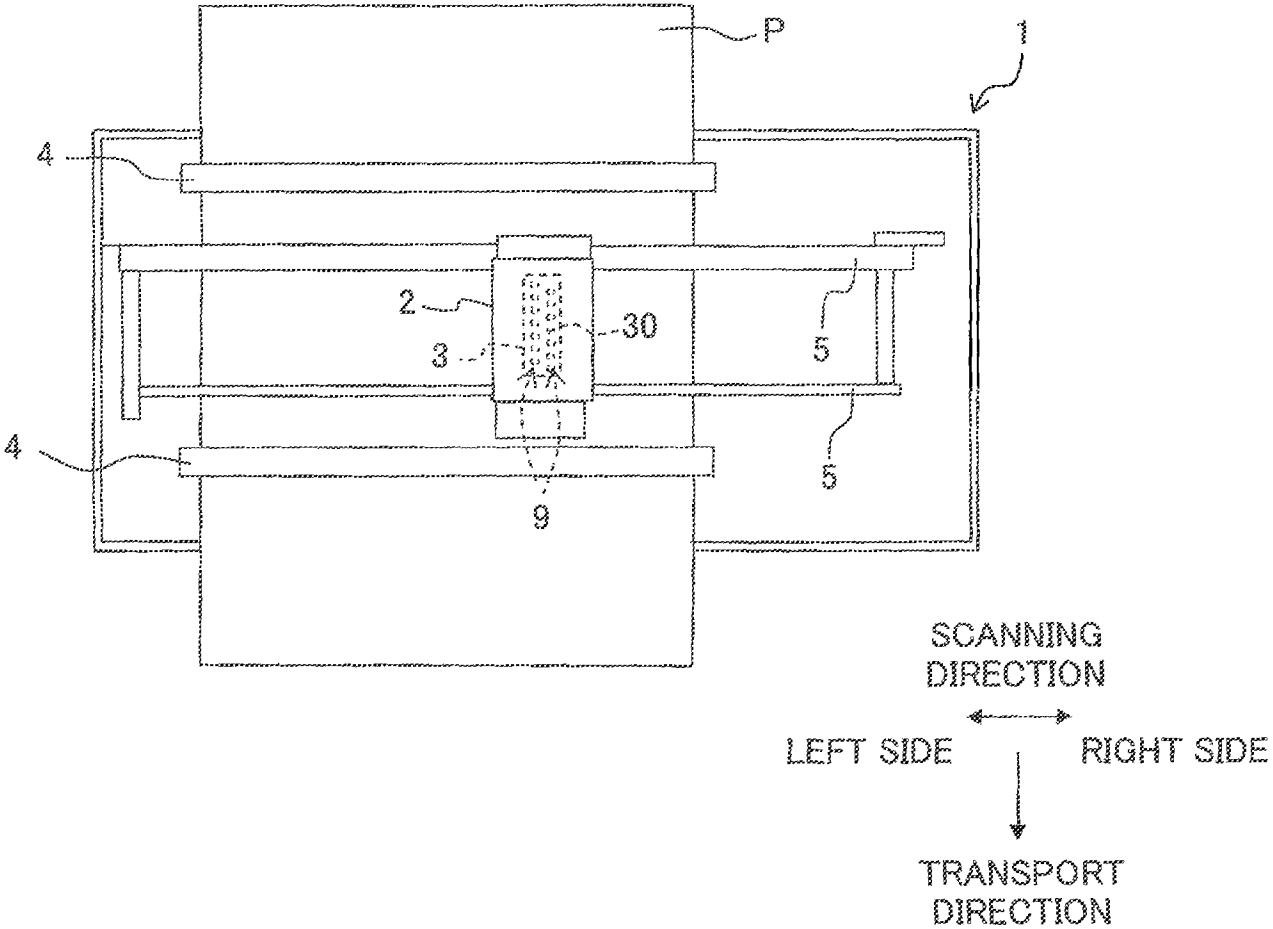
FIG. 1 is a schematic configuration diagram of a printer in accordance with an embodiment of the present teaching.

As shown in FIG. 1, a printer 1 in accordance with the present embodiment includes a carriage 2, an ink jet head 3, transport rollers 4, etc.

The carriage 2 is supported by two guide rails 5 extending in a scanning direction to move reciprocatingly along the guide rails 5 in the scanning direction. Further, the following explanation will be made with the left side and right side of the scanning direction defined as shown in FIG. 1. The ink jet head 3 is mounted on the carriage 2 to jet ink droplets from a plurality of nozzles 30 formed in a lower surface thereof. The transport rollers 4 are arranged on both sides of the carriage 2 in a transport direction orthogonal to the scanning direction and transport sheets of recording paper P in the transport direction.

The printer 1 carries out printing on the recording paper P by jetting ink droplets from the ink jet head 3 which moves together with the carriage 2 in the scanning direction, while transporting the recording paper P by the transport rollers 4 in the transport direction.

Figure 2:
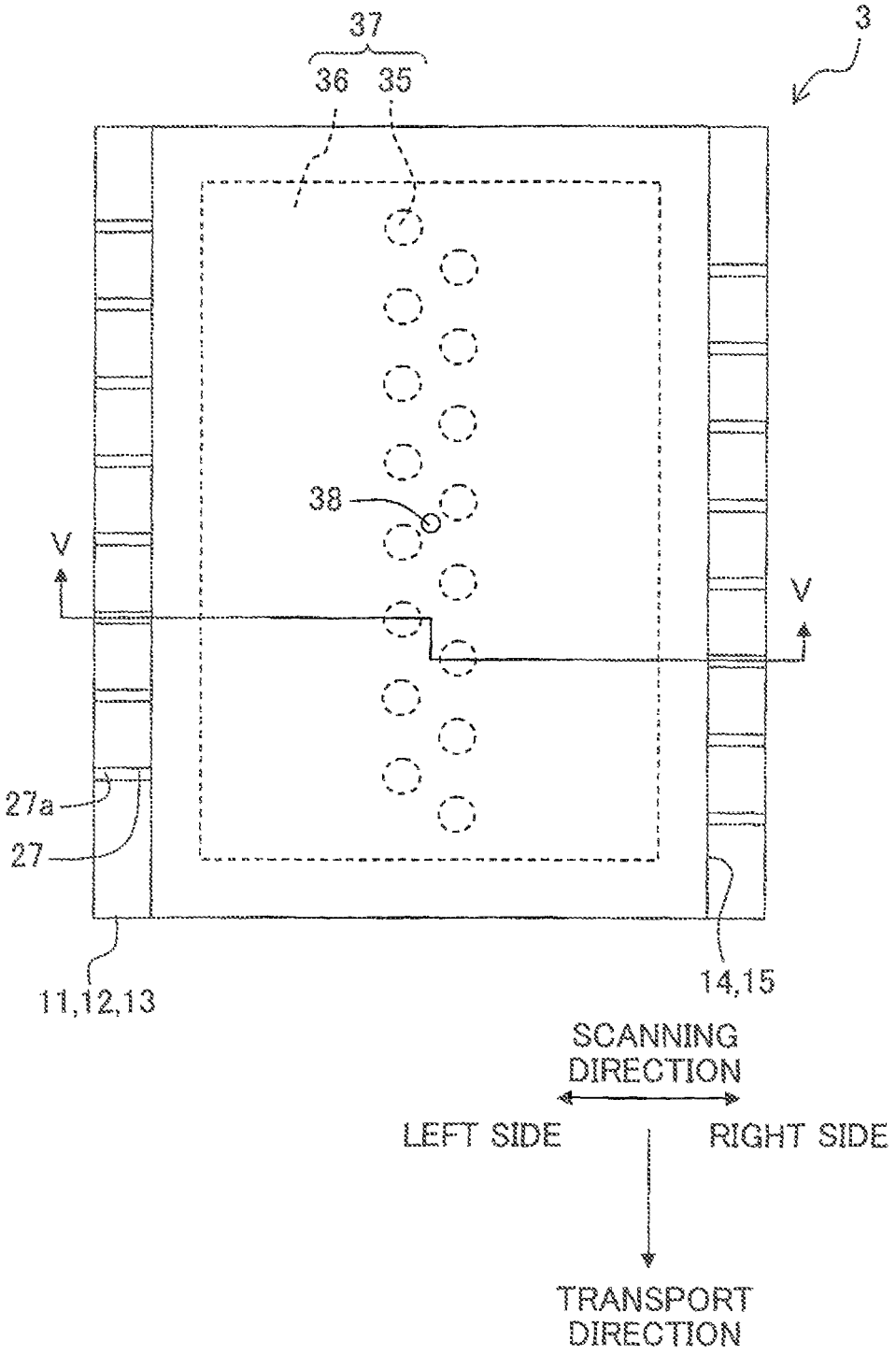
FIG. 2 is a plan view of an ink jet head of the printer of FIG. 1.
Figure 3:
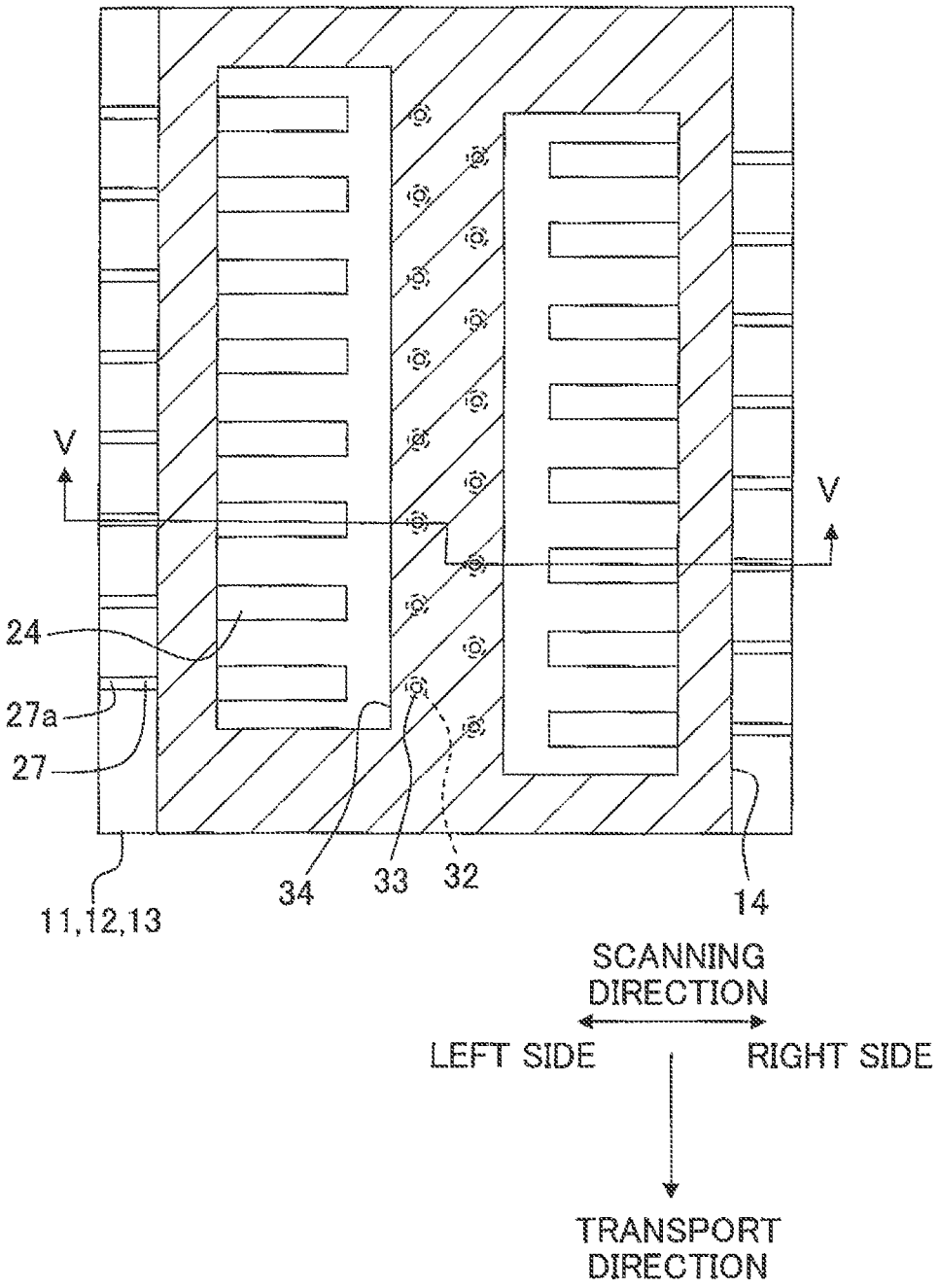
FIG. 3 is a view corresponding to FIG. 2 from which a storing chamber formation body is removed.
Figure 4:
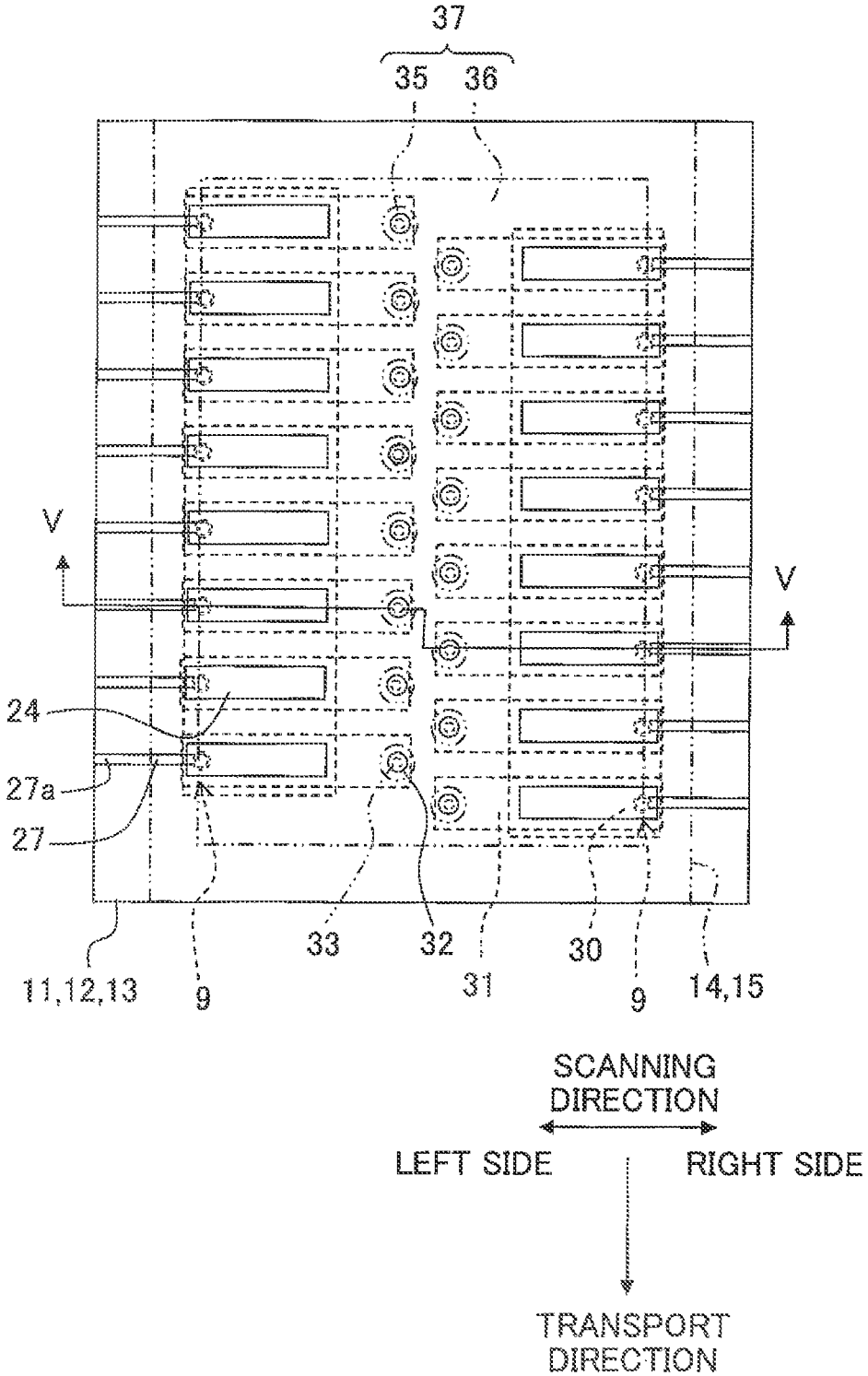
FIG. 4 is a view corresponding to FIG. 3 from which a resin layer is removed.
Figure 5:
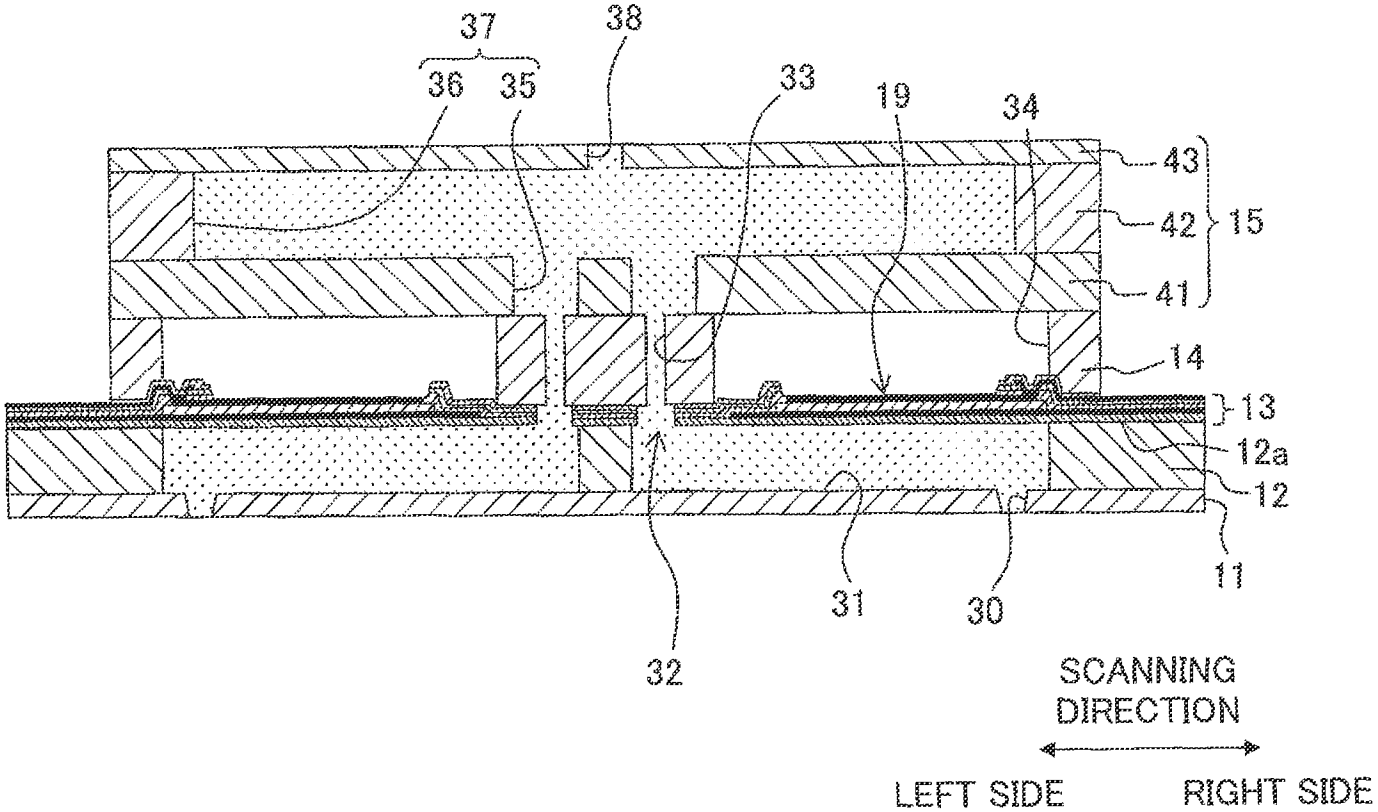
FIG. 5 is a cross-sectional view taken along the line V-V in FIGS. 2 to 4.
Figure 6:
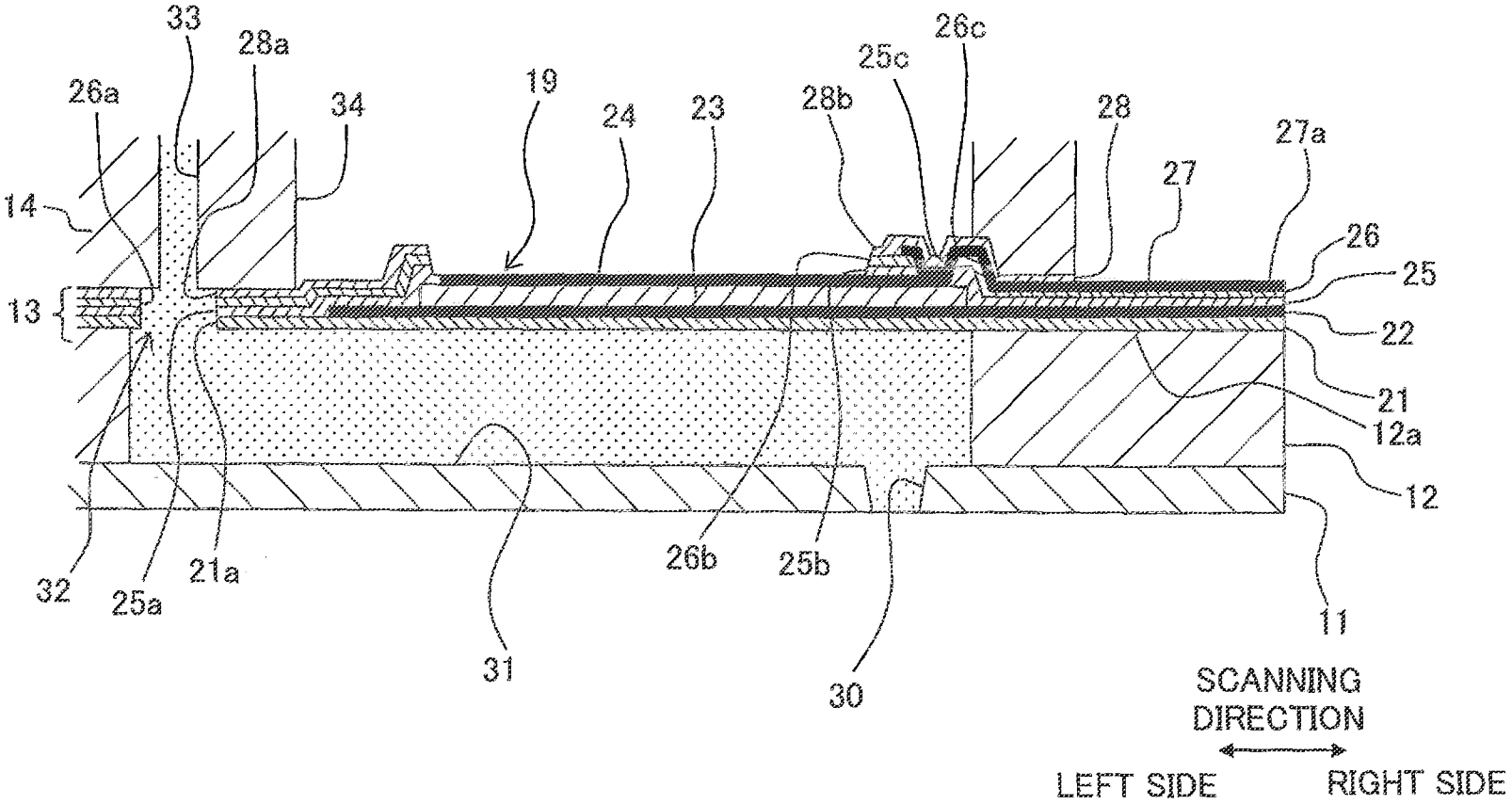
FIG. 6 is a partial enlarged view of FIG. 5.

Next, the ink jet head 3 will be explained. As shown in FIGS. 2 to 6, the ink jet head 3 includes a nozzle plate 11, a flow passage formation substrate 12, a thin film stacked body 13, a resin layer 14, and a reservoir unit 15. FIG. 2 only shows an aftermentioned ink storing chamber 37 among internally formed flow passages. FIG. 3 only shows aftermentioned connection flow passages 32 among the internally formed flow passages. In FIG. 3, the resin layer 14 is hatched. In FIG. 4, the aftermentioned ink storing chamber 37 and throttle flow passages 33 are shown by two-dot chain lines for making it easy to figure out positional relationship.

The nozzle plate 11 is made of a synthetic resin material such as polyimide or the like. The nozzle plate 11 is formed with the plurality of nozzles 30. The plurality of nozzles 30 are aligned in the transport direction to form nozzle rows 9. The nozzle plate 11 is formed with two nozzle rows 9 arranged in the scanning direction.

The flow passage formation substrate 12 is made of silicon. In the flow passage formation substrate 12, a plurality of pressure chambers 31 corresponding to the plurality of nozzles 30 are formed. Each of the pressure chambers 31 has such a planar shape as an approximate rectangle elongated in the scanning direction and has a constant height with respect to the scanning direction and the transport direction. Further, the plurality of pressure chambers 31 are aligned in the transport direction to correspond to the two nozzle rows 9. Then, the plurality of nozzles 30 forming the nozzle row 9 on the right side overlap with right end portions of the corresponding pressure chambers 31 in planar view. Further, the plurality of nozzles 30 forming the nozzle row 9 on the left side overlap with left end portions of the corresponding pressure chambers 31 in planar view.

In this embodiment, since each of the pressure chambers 31 has the elongated shape in the scanning direction, as compared with such a case in which each of the pressure chambers 31 has a square shape in planar view, it is possible to arrange, at a high density in the transport direction, the plurality of pressure chambers 31 and the plurality of nozzles 30 in communication with the plurality of pressure chambers 31.

The thin film stacked body 13 includes an ink separation layer 21, a common electrode 22, a piezoelectric layer 23, a plurality of individual electrodes 24, protective layers 25 and 26, a plurality of wires 27, and another protective layer 28.

The ink separation layer 21 is formed of silicon dioxide ($SiO_2$) or the like and extends over an entire area of an upper surface 12*a* of the flow passage formation substrate 12. Further, through holes 21*a* are formed in such portions, of the ink separation layer 21, overlapping with end portions, of the pressure chambers 31, on the side opposite to the nozzles 30 in the scanning direction, in planar view.

The common electrode 22 is made of a metallic material, and formed on the upper surface of the ink separation layer 21. The common electrode 22 extends continuously across the plurality of pressure chambers 31. Further, the common electrode 22 is constantly maintained at ground potential.

The piezoelectric layer 23 is made of a piezoelectric material consisting mainly of lead zirconate titanate which is a mixed crystal of lead titanate and lead zirconate, and is arranged on the upper surface of the common electrode 22 formed on the upper surface of the ink separation layer 21. Further, the piezoelectric layer 23 extends continuously across the plurality of pressure chambers 31 corresponding to the respective nozzle rows 9. The piezoelectric layer 23 is polarized beforehand in its thickness direction (downward in FIG. 6, for example).

Each of the plurality of individual electrodes 24 has such a planar shape as an approximate rectangle elongated in the scanning direction, and is formed on the upper surface of the piezoelectric layer 23 in such a portion overlapping with one of the pressure chambers 31 in planar view.

The protective layer 25 is formed of alumina ($Al_2O_3$), silicon nitride, etc. The protective layer 25 is formed over the upper surface of the ink separation layer 21 formed with the common electrode 22, piezoelectric layer 23, and a plurality of individual electrodes 24, so as to cover the common electrode 22, piezoelectric layer 23, and the plurality of individual electrodes 24. A through hole 25*a* is formed in each portion of the protective layer 25 overlapping, in planar view, with one of the through holes 21*a*. A through hole 25*b* is formed in each portion of the protective layer 25 overlapping, in planar view, with most part including the central part of one of the pressure chambers 31. A through hole 25*c* is formed in each portion of the protective layer 25 overlapping, in planar view, with an end portion, of one of the individual electrodes 24, on the side of the nozzle 30 in the scanning direction.

The protective layer 26 is formed of silicon dioxide, etc. The protective layer 26 is formed on the upper surface of the protective layer 25 to cover, together with the protective layer 25, the common electrode 22, piezoelectric layer 23, and the plurality of individual electrodes 24. A through hole 26*a* is formed in each portion of the protective layer 26 overlapping, in planar view, with one of the through holes 25*a*. A through hole 26*b* is formed in each portion of the protective layer 26 overlapping, in planar view, with one of the through holes 25*b*. A through hole 26*c* is formed in each portion of the protective layer 26 overlapping, in planar view, with one of the through holes 25*c*. By virtue of this, the plurality of individual electrodes 24 are exposed respectively from the through holes 25*b* and 26*b* and from the through holes 25*c* and 26*c*. Further, instead of the two protective layers 25 and 26, it is also possible to provide one protective layer formed of silicon dioxide.

The plurality of wires 27 are formed on the upper surface of the protective layer 26. The plurality of wires 27 are provided to correspond to the plurality of individual electrodes 24, and connected to the corresponding individual electrodes 24 respectively at the portions exposed from the through holes 25*c* and 26*c*. The plurality of wires 27 extend away from the nozzles 30 in planar view, from the portions connected with the individual electrodes 24 up to the ends of the flow passage formation substrate 12 in the scanning direction. End portions of the wires 27 on a side opposite to the portions connected with the individual electrodes 24 serve as connecting terminals 27*a*. The connecting terminals 27*a* are connected with an unshown driver IC via an unshown wiring member. By virtue of this, the driver IC can individually apply, to each of the individual electrodes 24, either a predetermined driving potential or the ground potential selectively.

The protective layer 28 is formed over the upper surface of the protective layer 26 formed with the plurality of wires 27 to cover the plurality of wires 27. A through hole 28*a* is formed in each portion of the protective layer 28 overlapping, in planar view, with one of the through holes 26*a*. Further, a through hole 28*b* is formed in each portion of the protective layer 28 overlapping, in planar view, with one of the through holes 26*b*.

The thickness of each of the ink separation layer 21, common electrode 22, plurality of piezoelectric layer 23, plurality of individual electrodes 24, protective layers 25 and 26, plurality of wires 27, and protective layer 28, all of which constitute the thin film stacked body 13, is approximately 1 to 3 μm. Further, in this embodiment, because the through holes 21*a*, 25*a*, 26*a* and 28*a* overlap vertically with one another, the connection flow passages 32 connected to the pressure chambers 31 respectively are formed to penetrate the thin film stacked body 13 in the vertical direction. Further, in the thin film stacked body 13, each portion of the ink separation layer 21, common electrode 22, piezoelectric layer 23 and individual electrodes 24, which overlaps with one of the pressure chambers 31 in planar view, serves as a piezoelectric element 19.

Here, operation of the piezoelectric elements 19 will be explained. In the piezoelectric elements 19, the individual electrodes 24 are maintained at the ground potential beforehand in the same manner as the common electrode 22. If the potential of the individual electrodes 24 is switched from the ground potential to the aforementioned driving potential, due to the potential difference between the individual electrodes 24 and the common electrode 22, an electric field is generated along the thickness direction (downward in FIG. 6) in each of the portions of the piezoelectric layer 23 sandwiched between the individual electrodes 24 and the common electrode 22. Since the direction of this electric field is parallel to the aforementioned polarization direction of the piezoelectric layer 23, the above-mentioned portions of the piezoelectric layer 23 shrink in the planar direction and, along with this, the piezoelectric layer 23 and ink separation layer 21 deform in those portions as a whole to project toward the pressure chambers 31. By virtue of this, the pressure chambers 31 decrease in volume to cause an increase in the pressure on the ink inside the pressure chambers 31, thereby jetting the ink droplets from the nozzles 30 in communication with the pressure chambers 31.

The resin layer 14 is a member made of a synthetic resin material such as epoxy resin or the like and having a thickness of approximately 30 to 50 μm The resin layer 14 is arranged on the upper surface of the protective layer 28 at a region except for both end portions in the scanning direction.

Further, the throttle flow passage 33 is formed to penetrate vertically through the resin layer 14, without bending with respect to the scanning direction and the transport direction, in each portion of the resin layer 14 overlapping with one of the connection flow passages 32 in planar view. In other words, the throttle flow passages 33 overlap with the connection flow passages 32 respectively when viewed from a direction orthogonal to the surface of the flow passage formation substrate 12. By virtue of this, each of the throttle flow passages 33 overlaps, when viewed from the direction orthogonal to the surface of the flow passage formation substrate 12, with an end portion of one of the pressure chambers 31 on the side opposite to the nozzles 30 in the scanning direction. The throttle flow passage 33 has the greatest flow resistance in each ink flow passage from the aftermentioned ink storing chamber 37 to one of the pressure chambers 31, and is configured to restrict the amount of ink flowing from the ink storing chamber 37 into the one of the pressure chambers 31.

Further, in this embodiment, since each of the throttle flow passages 33 overlaps in planar view with one of the pressure chambers 31, as compared with a case in which the throttle flow passages 33 are formed in the flow passage formation substrate 12 and the pressure chambers 31 and the throttle flow passages 33 are arranged in the scanning direction, it is possible to reduce the length of the flow passage formation substrate 12 in the scanning direction. By virtue of this, it is possible to restrain the ink jet head 3 from growing in size in the scanning direction.

If each of the pressure chambers 31 has an elongated shape in the scanning direction in planar view as described above, the flow passage formation substrate 12 is likely to be long in the scanning direction, and thus the ink jet head 3 is likely to grow in size in the scanning direction. Therefore, in this embodiment, it is of a great significance for restraining the ink jet head 3 from growing in size in the scanning direction, by arranging each of the throttle flow passages 33 to overlap, in planar view, with the end portion of one of the pressure chambers 31 in the longitudinal direction, as described above.

Here, if each of the throttle flow passages 33 overlaps with the end portion of one of the pressure chambers 31 in the longitudinal direction, it is not possible for each of the piezoelectric elements 19 to extend up to a position overlapping, in planar view, with the end portion of one of the pressure chambers 31 in the longitudinal direction. However, if each of the pressure chambers 31 has an elongated shape in one direction in planar view, between a case in which each of the piezoelectric elements 19 extends up to the position overlapping in planar view with the end portion of one of the pressure chambers 31 in the longitudinal direction and a case in which each of the piezoelectric elements 19 does not extend up to the position overlapping in planar view with the end portion of one of the pressure chambers 31 in the longitudinal direction, there is little change in the extent of deformation of the piezoelectric layer 23 and the ink separation layer 21 when the piezoelectric elements 19 are driven.

Further, when viewed from the direction orthogonal to the surface of the flow passage formation substrate 12, each of the throttle flow passages 33 has a cross-sectional area than that of corresponding connection flow passage 32. Each of the throttle flow passages 33 is a little smaller in diameter than the corresponding connection flow passage 32. For example, the diameter of each of the connection flow passages 32 is approximately 32 μm, whereas the diameter of each of the throttle flow passages 33 is 30 μm. Further, each of the throttle flow passages 33 entirely overlaps, in planar view, with the corresponding connection flow passage 32. In other words, when viewed from the direction orthogonal to the surface of the flow passage formation substrate 12, the entire cross section of each of the throttle flow passages 33 overlaps with the cross section of one of the connection flow passages 32. By virtue of this, the resin layer 14 completely covers an inner wall of each of the connection flow passages 32 of the thin film stacked body 13. Therefore, it is possible to prevent damage of the ink separation layer 21 and protective layers 25, 26 and 28 which constitute the thin film stacked body 13. If the ink separation layer 21 and protective layers 25, 26 and 28 are damaged, their broken pieces flow, as foreign substances, toward the pressure chambers 31 and cause some problems. In this embodiment, since the inner wall of each of the connection flow passages 32 does not overlap, in planar view, with one of the throttle flow passages 33, the ink flow from each of the throttle flow passages 33 toward one of the pressure chambers 31 is not hindered by the inner wall of each of the connection flow passages 32 and the ink flows smoothly from each of the throttle flow passages 33 to one of the pressure chambers 31.

A through hole 34 is formed in each portion of the resin layer 14 overlapping, in planar view, with one of the piezoelectric elements 19. Then, each of the aforementioned plurality of wires 27 extends, in planar view, from the portion connected with one of the individual electrodes 24 and overlapping with one of the through holes 34, up to one of the connecting terminals 27*a* not overlapping with the resin layer 14, via a portion overlapping with a portion, of the resin layer 14, at which the through hole 34 is not formed.

The reservoir unit 15 includes a lower member 41, an intermediate member 42, and an upper member 43. The lower member 41 is a plate-like member made of a metallic material, silicon or the like, and is arranged on the upper surface of the resin layer 14. A through hole 35 greater in diameter than each of the throttle flow passages 33 is formed in each portion of the lower member 41 overlapping, in planar view, with one of the throttle flow passages 33. By arranging the lower member 41 in this manner, the piezoelectric elements 19 are covered and protected by the inner walls of the through holes 34 of the resin layer 14, and the lower member 41.

The intermediate member 42 is another plate-like member made of the same material as the lower member 41, and is arranged on the upper surface of the lower member 41. A through hole 36 is formed in almost the entire area of the intermediate member 42. In this embodiment, the space formed by the through holes 35 and through hole 36 serves as the ink storing chamber 37 for storing the ink.

The upper member 43 is still another plate-like member made of the same material as the lower member 41 and intermediate member 42, and is arranged on the upper surface of the intermediate member 42. An ink supply flow passage 38 is provided in the approximate central portion of the upper member 43 to penetrate through the upper member 43. By virtue of this, the lower end of the ink supply flow passage 38 is connected to the ink storing chamber 37. The upper end of the ink supply flow passage 38 is connected to an unshown ink cartridge via an unshown tube and the like. By virtue of this, the ink stored in the ink cartridge is supplied to the ink storing chamber 37 via the ink supply flow passage 38.

In this embodiment, the nozzles 30, pressure chambers 31, throttle flow passages 33 and ink storing chamber 37 have a positional relationship as described above, and the nozzles 30, pressure chambers 31, throttle flow passages 33, and ink storing chamber 37 are vertically arranged in this order from below. Further, in this embodiment, the through holes 34 are formed in the resin layer 14, and the reservoir unit 15 is arranged not to hinder the driving of the piezoelectric elements 19.

Figure 7:
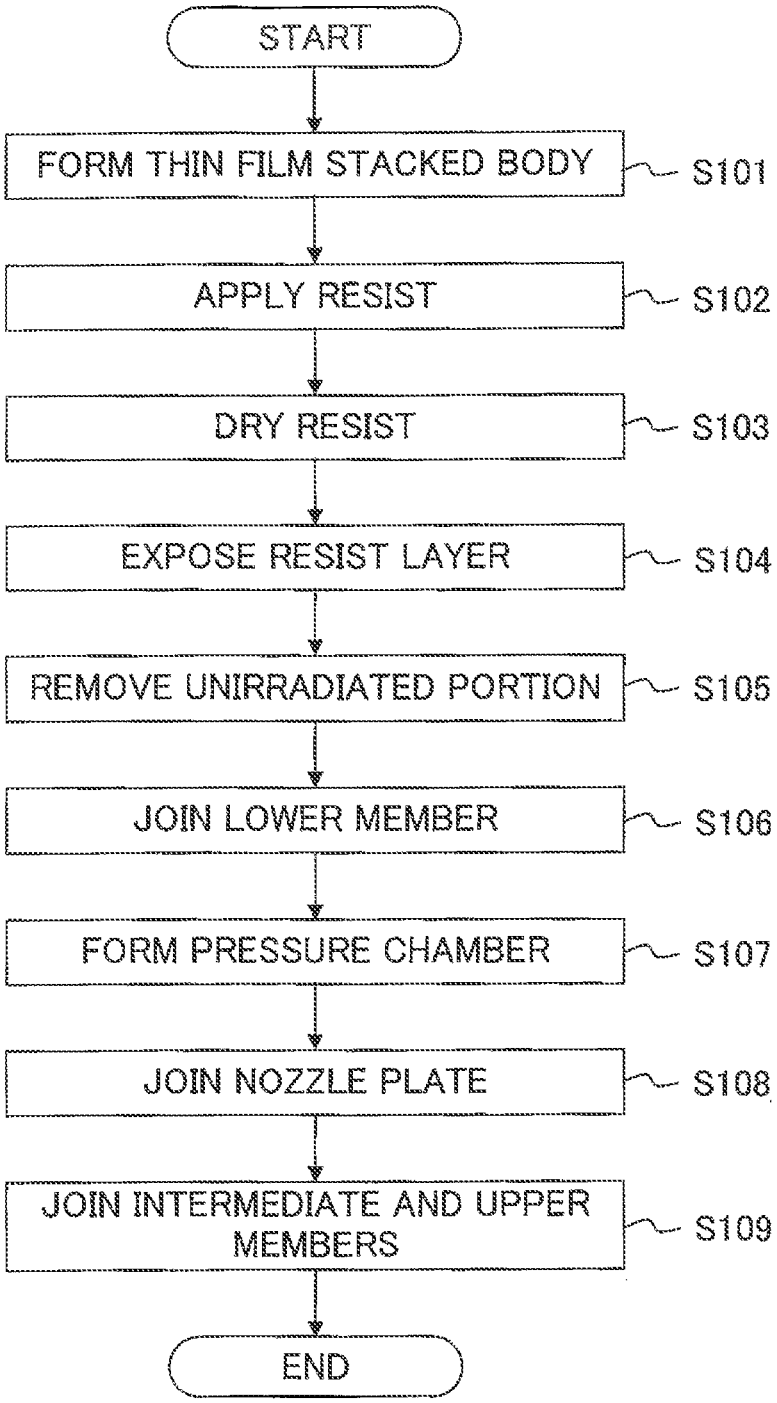
FIG. 7 is a flowchart showing a procedure of manufacturing the ink jet head.
Figure 8A:
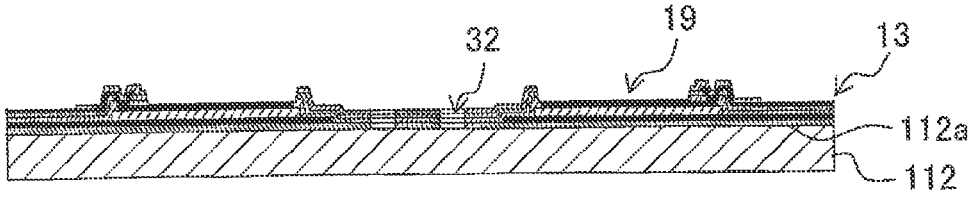
FIG. 8A shows a state in which a thin film stacked body is formed on a silicon substrate.

Next, using the flowchart of FIG. 7, a method for manufacturing the ink jet head 3 will be explained. In order to manufacture the ink jet head 3, as shown in FIG. 8A, the thin film stacked body 13 including the piezoelectric elements 19 is formed first on an upper surface 112*a* of a silicon substrate 112, which will form the flow passage formation substrate 12 later (step S101). The silicon substrate 112 has a thickness corresponding to the height of the pressure chambers 31. In the flowing explanation, such phrases as "step S101" will be simply expressed as "S101" and the like. Further, in FIGS. 8A to 8D and FIGS. 9A to 9D, in order to see the drawings clearly, each layer of the thin film stacked body 13 is illustrated to be thicker than in FIGS. 5 and 6.

Because the same conventional method for forming the thin film stacked body 13 is used here, a detailed explanation therefor will be omitted. To explain simply, the thin film stacked body 13 is formed according to a publicly known film formation method such as the sol-gel method, sputtering method or the like by sequentially forming the film of each layer of the thin film stacked body 13 and then removing the needless parts of the formed films through etching or the like at proper timings.

Figure 8B:
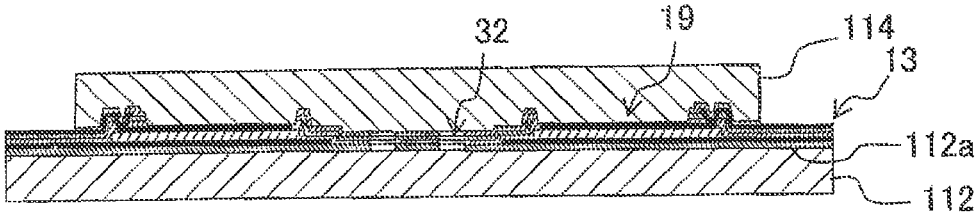
FIG. 8B shows a state in which a resist layer is formed on the silicon substrate.

Next, according to a film formation method such as the spin coat method or the like, a liquid resist containing a photosensitive resin is applied to the silicon substrate 112 formed with the thin film stacked body 13 (S102). Then, the applied resist is dried (S103). By virtue of this, as shown in FIG. 8B, a resist layer 114 is formed over the silicon substrate 112 formed with the thin film stacked body 13.

Figure 8C:
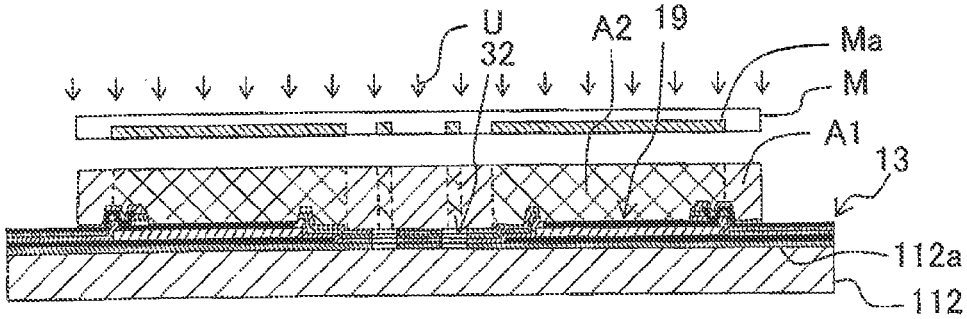
FIG. 8C shows a state of exposing the resist layer.

Next, the resist layer 114 is exposed (S104). To explain in more detail, as shown in FIG. 8C, a photomask M is arranged above the resist layer 114. The photomask M has light shielding portions Ma for shielding, from any light ray, such portions of the resist layer 114 at which the throttle flow passages 33 and through holes 34 will be formed. Then, an ultraviolet ray U is radiated from above the photomask M toward the resist layer 114. By virtue of this, such portions of the resist layer 114 as not to overlap in planar view with the light shielding portions Ma are formed as irradiated portions A1 irradiated with the ultraviolet ray. Further, such portions of the resist layer 114 as to overlap in planar view with the light shielding portions Ma are formed as unirradiated portions A2 not irradiated with the ultraviolet ray. Here, the resist forming the resist layer 114 is a so-called negative resist. Therefore, between the irradiated portion A1 and the unirradiated portions A2 formed in the resist layer 114 through the exposure, only the unirradiated portions A2 can be removed with a developer such as an alkaline aqueous solution, organic solvent, or the like. In this case, the irradiated portion A1 is hardened when the resist layer 114 is irradiated with the ultraviolet ray U in the above step S104.

Figure 8D:
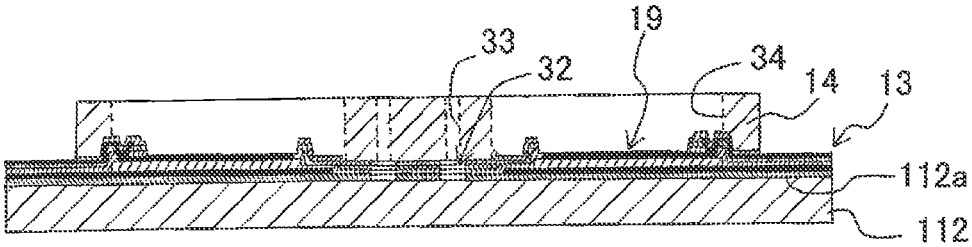
FIG. 8D shows a state in which an irradiated portion of the resist layer has been removed.

Next, as shown in FIG. 8D, a developer is used to remove the unirradiated portions A2 of the resist layer 114 (S105). By virtue of this, the resist layer 114 becomes the resin layer 14 formed with the throttle flow passages 33 and through holes 34.

In this manner, in this embodiment, the resist layer 114 is formed over the silicon substrate 112 formed with the thin film stacked body 13, and the irradiated portion A1 and unirradiated portions A2 are formed by irradiating the resist layer 114 with a light ray. Then, the resin layer 14, formed with the throttle flow passages 33, is formed by removing the unirradiated portions A2 with the developer. Therefore, as compared with a case, in which a member preformed with the throttle flow passages 33 is joined to the top of the silicon substrate 112 formed with the thin film stacked body 13, or the like, it is possible to improve the precision of positioning the throttle flow passages 33 with respect to the pressure chambers 31.

In this embodiment, since the thin film stacked body 13 includes the plurality of wires 27, concaves and convexes approximately as thick as each of the wires 27 are formed in such portions of the upper surface of the thin film stacked body 13 as to overlap, in planar view, with the plurality of wires 27. On the other hand, the plurality of wires 27 overlap, in planar view, with such portions of the resin layer 14 as not formed with the throttle flow passages 33 and through holes 34. In this embodiment, the resist layer 114 is formed by applying a liquid resist containing a photosensitive resin to the silicon substrate 112 formed with the thin film stacked body 13, and drying the resist. Accordingly, when applying the liquid resist, the liquid resist flows along the concaves and convexes of the upper surface of the thin film stacked body 13 such that no interspace is formed between the resist layer 114 and the thin film stacked body 13. Therefore, it is possible to prevent the ink from leaking out from between the thin film stacked body 13 and the resin layer 14.

Meanwhile, the lower surface of the resist layer 114 has convexes and concaves corresponding to the concaves and convexes of the upper surface of the thin film stacked body 13. In this embodiment, as described above, the resin layer 14, as well as the resist layer 114 which will form the resin layer 14, is ten times or more as thick as each of the wires 27. Therefore, the upper surface of the resin layer 14 is a flat surface without concaves and convexes.

Figure 9A:
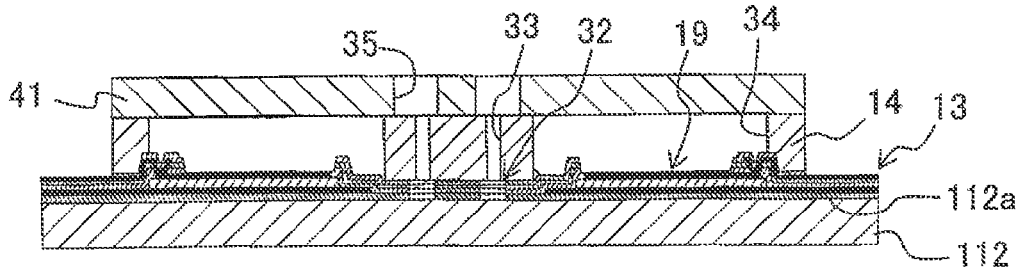
FIG. 9A shows a state in which a lower member is joined to the resin layer.
Figure 9B:
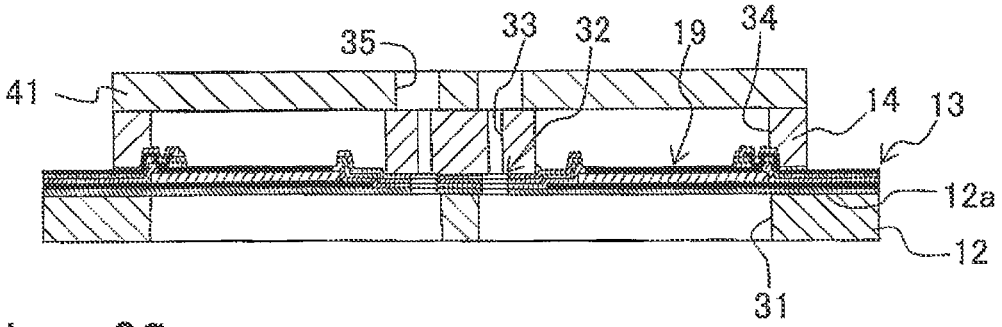
FIG. 9B shows a state in which pressure chambers are formed in the silicon substrate.
Figure 9C:
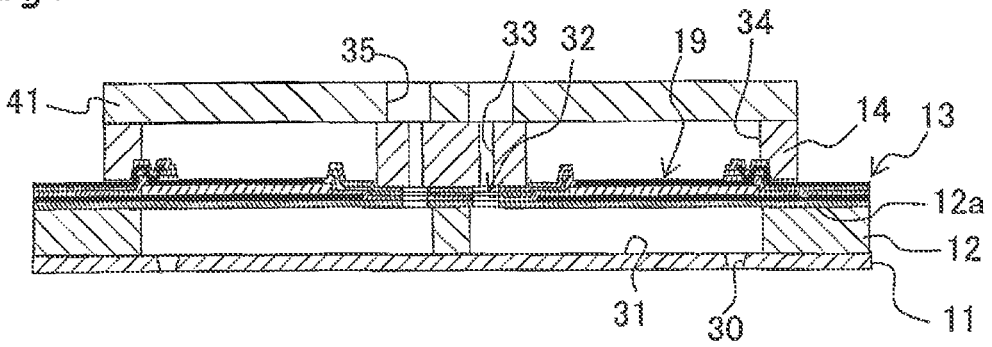
FIG. 9C shows a state in which a nozzle plate has been joined to the silicon substrate.
Figure 9D:
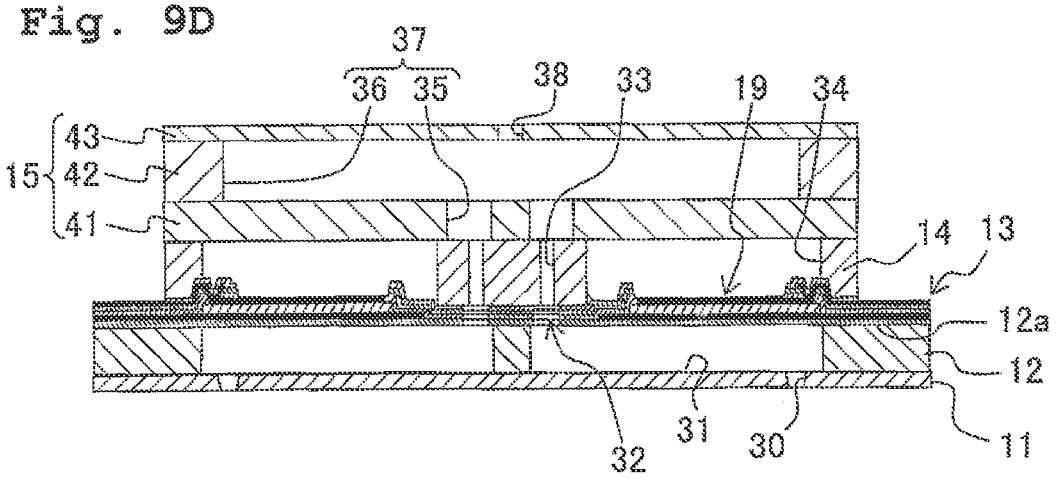
FIG. 9D shows a state in which an intermediate member and an upper member have been joined to the lower member.

Next, as shown in FIG. 9A, the prefabricated lower member 41 is joined to the upper surface of the resin layer 14 with an adhesive or the like (S106). Then, the thickness of the silicon substrate 112 is adjusted by abrading the lower surface of the silicon substrate 112 and, as shown in FIG. 9B, the pressure chambers 31 are formed in the silicon substrate 112 through etching or the like (S107). With this step, the silicon substrate 112 becomes the flow passage formation substrate 12 formed with the pressure chambers 31. Then, as shown in FIG. 9C, the prefabricated nozzle plate 11 is joined to the lower surface of the flow passage formation substrate 12 (S108). Then, as shown in FIG. 9D, the prefabricated intermediate member 42 is joined to the upper surface of the lower member 41 and, furthermore, the prefabricated upper member 43 is joined to the upper surface of the intermediate member 42 (S109).

In this embodiment, by sequentially joining the members 41 to 43 to the upper surface of the resin layer 14 as in S106 and S109, it is possible to easily form the reservoir unit 15 formed with the ink storing chamber 37 of a greater volume than the throttle flow passages 33. Since the throttle flow passages 33 serve to adjust the amount of ink flowing into the pressure chambers 31, they are required to have a comparatively high positional precision with respect to the pressure chambers 31. On the other hand, since the ink storing chamber 37 is provided to temporarily store the ink for supplying the pressure chambers 31, it is not required to have such a high positional precision as the throttle flow passages 33. Therefore, there is no problem even if a little positional deviation occurs when joining the members 41 to 43.

As described above, in this embodiment, since the upper surface of the resin layer 14 is a flat surface without concaves and convexes, when the lower member 41 is joined to the upper surface of the resin layer 14, it is possible to prevent formation of any interspace between the resin layer 14 and the lower member 41.

In this manner, the ink jet head 3 is manufactured through the above steps S101 to 109.

In this embodiment, the ink jet head 3 corresponds to the liquid droplet jetting apparatus of the present teaching. The flow passage formation substrate 12 corresponds to the first flow passage formation body of the present teaching, while the direction along the surface of the flow passage formation substrate 12 corresponds to the predetermined planar direction of the present teaching. The ink separation layer 21, common electrode 22, piezoelectric layer 23, individual electrodes 24, protective layers 25 and 26, wires 27, and protective layer 28, all of which constitute the thin film stacked body 13, correspond to the plurality of layers of the present teaching. The ink storing chamber 37 corresponds to the liquid storing chamber of the present teaching. The reservoir unit 15 corresponds to the storing chamber formation member of the present teaching, the lower member 41 corresponds to the first storing chamber formation member of the present teaching, and the intermediate member 42 and upper member 43 correspond to the second storing chamber formation member of the present teaching. The combination of the resin layer 14 and reservoir unit 15 corresponds to the second flow passage formation body of the present teaching. Further, the scanning direction corresponds to the predetermined one direction of the present teaching.

In this embodiment, the step S101 corresponds to the piezoelectric element formation step of the present teaching. The combination of the steps S102 and 103 corresponds to the resist layer formation step of the present teaching. The step S104 corresponds to the exposure step of the present teaching. The step S105 corresponds to the removal step of the present teaching. The step S106 corresponds to the first storing chamber formation member joining step of the present teaching, the step S109 corresponds to the second storing chamber formation member joining step of the present teaching, and the combination of these two steps corresponds to the storing chamber formation member joining step of the present teaching. Further, the unirradiated portions A2 correspond to the one portion of the present teaching, while the irradiated portion A1 corresponds to the other portion of the present teaching.

Next, a couple of modifications applying various changes to the above embodiment will be explained.

Figure 10:
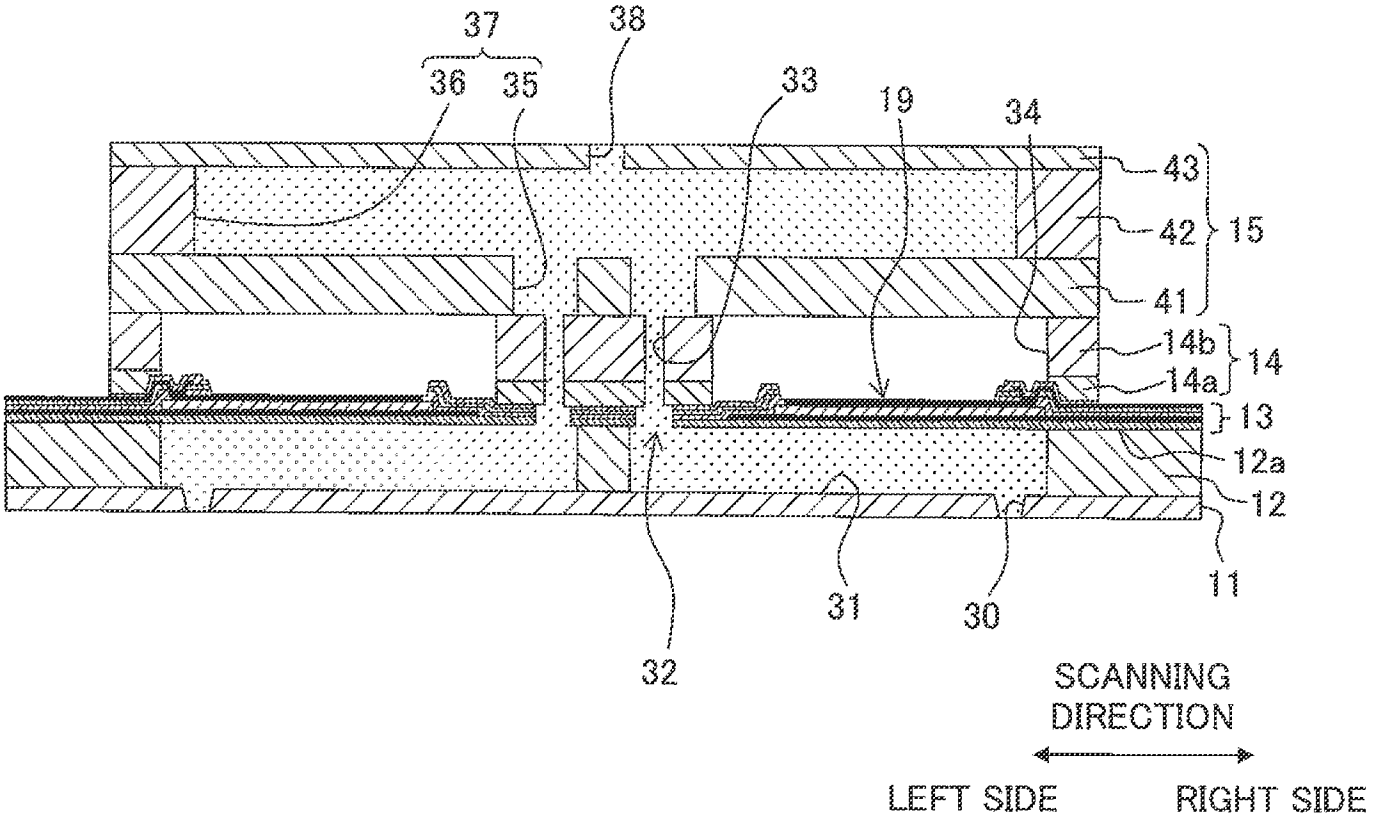
FIG. 10 is a view corresponding to FIG. 5 in accordance with a first modification.

In the above embodiment, the resin layer 14 is formed of one hardened resist layer. However, without being limited to this, in one modification (a first modification) as shown in FIG. 10, the resin layer 14 is formed integrally by a first resin layer 14*a* arranged over the flow passage formation substrate 12 formed with the thin film stacked body 13, and a second resin layer 14*b* arranged on the upper surface of the first resin layer 14*a*. Each of the first resin layer 14*a* and the second resin layer 14*b* is formed by hardening a photosensitive resin. Here, the first resin layer 14*a* and the second resin layer 14*b* may be formed of the same resin material or be formed of different resin materials.

Figure 11:
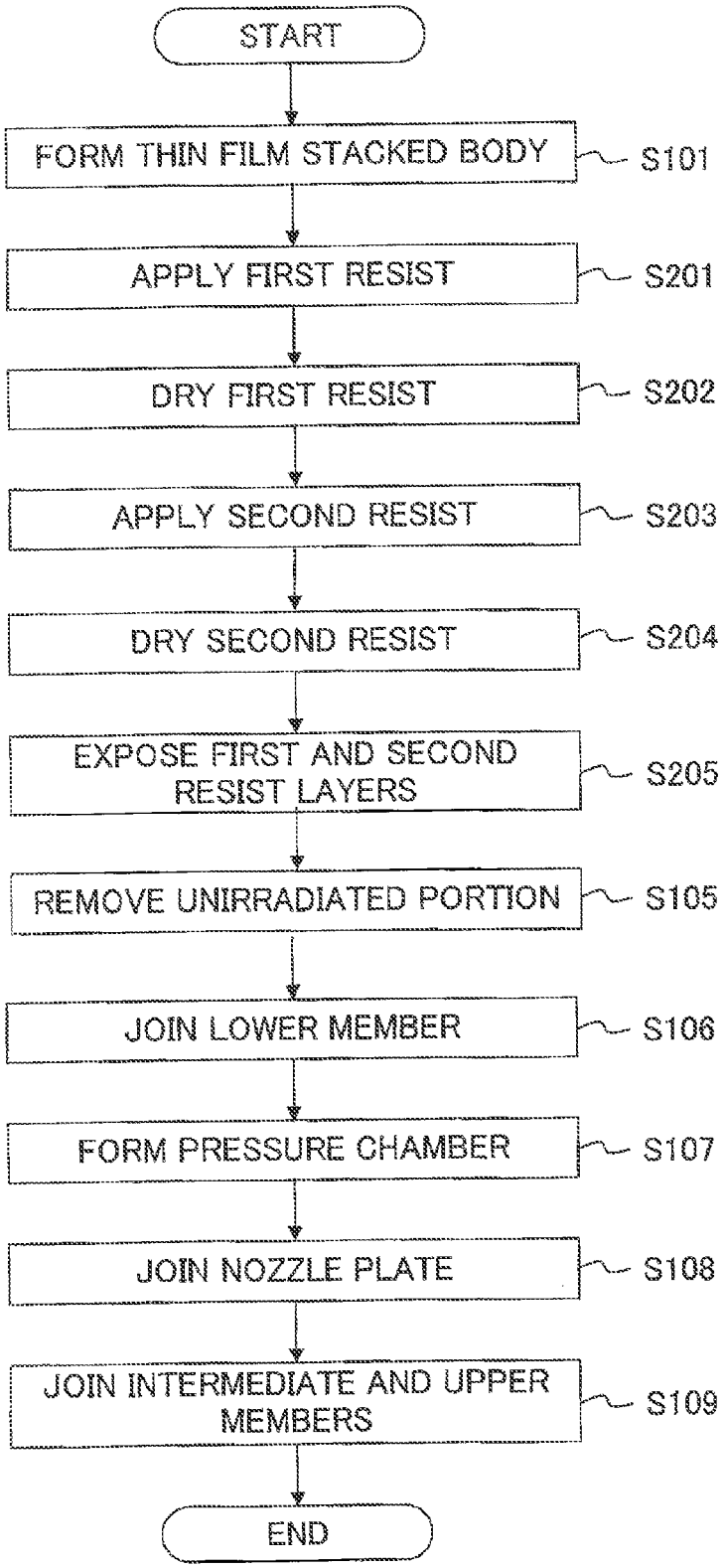
FIG. 11 is a flowchart corresponding to FIG. 7 in accordance with the first modification.
Figure 12A:
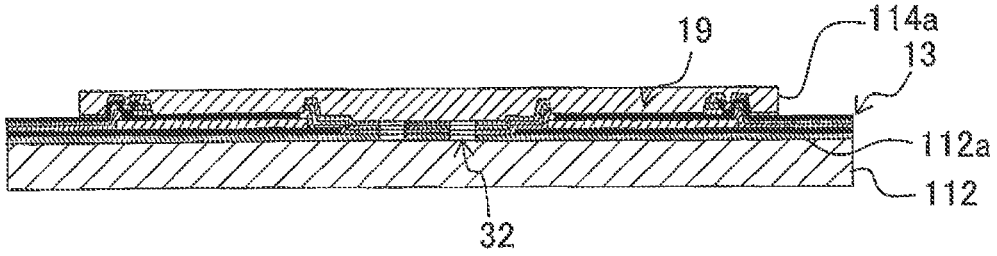
FIG. 12A shows a state in which a first resist layer has been formed in the first modification.

In this case, as shown in FIG. 11, after the aforementioned step S101, according to a film formation method such as the spin coat method or the like, a liquid first resist containing the photosensitive resin is applied to the silicon substrate 112 formed with the thin film stacked body 13 (S201), and then the applied first resist is dried (S202). By virtue of this, as shown in FIG. 12A, a first resist layer 114*a* is formed over the silicon substrate 112 formed with the thin film stacked body 13.

Figure 12B:
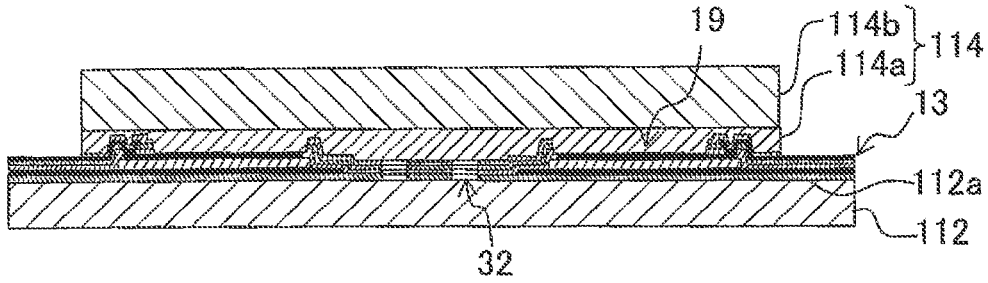
FIG. 12B shows a state in which a second resist layer has been formed in the first modification.

Next, according to a film formation method such as the spin coat method or the like, a liquid second resist containing the photosensitive resin is applied to the upper surface of the first resist layer 114*a* (S203), and then the applied second resist is dried (S204). By virtue of this, as shown in FIG. 12B, a second resist layer 114*b* is formed on the upper surface of the first resist layer 114*a*. Each layer of the thin film stacked body 13, as well as the resist layer 114, is illustrated to be thicker in FIGS. 12A to 12D than in FIG. 10.

Here, the viscosity of the first resist before being hardened is lower than that of the second resist before being hardened. For example, the first resist and the second resist may contain the same type of photosensitive resin, and the photosensitive resin of the first resist when being applied may be thinner than the photosensitive resin of the second resist when being applied. Alternatively, such a difference in viscosity as described above may be produced by letting the photosensitive resin contained in the first resist differ in type from the photosensitive resin contained in the second resist.

Figure 12C:
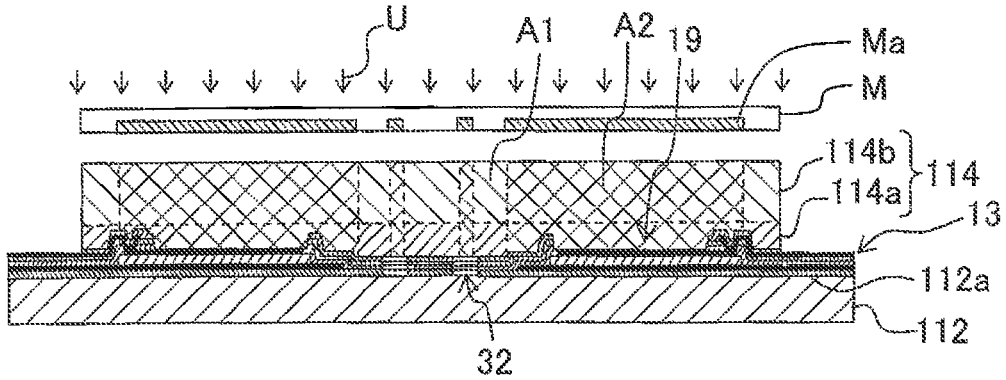
FIG. 12C shows a state in which the first and second resist layers are exposed in the first modification.
Figure 12D:
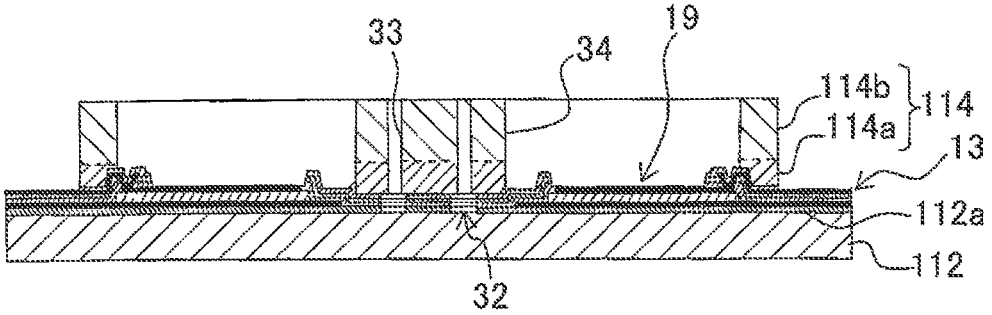
FIG. 12D shows a state in which irradiated portions of the first and second resist layers have been removed in the first modification.

Next, the first resist layer 114*a* and the second resist layer 114*b* are exposed (S205). To explain in more detail, as shown in FIG. 12C, the same photomask M as in the above embodiment is arranged above the resist layer 114 formed by stacking the first resist layer 114*a* and the second resist layer 114*b*. Then, the ultraviolet ray U is radiated from above the photomask M toward the resist layer 114. By virtue of this, such portions of the first resist layer 114*a* and second resist layer 114*b* as not to overlap in planar view with the light shielding portions Ma are formed as the irradiated portions A1 hardened through irradiation with the ultraviolet ray. Further, such portions of the first resist layer 114*a* and second resist layer 114*b* as to overlap in planar view with the light shielding portions Ma are formed as the unirradiated portions A2 not irradiated with the ultraviolet ray.

Thereafter, the process of manufacturing the ink jet head 3 is carried out through the steps S105 to S109 in the same manner as the above embodiment.

In the first modification, since the viscosity of the first resist when being applied is lower than that of the second resist when being applied, when applying the liquid first resist, the liquid first resist flows reliably along the concaves and convexes of the upper surface of the thin film stacked body 13 such that no interspace is formed between the first resist layer 114*a* and the thin film stacked body 13. By virtue of this, it is possible to prevent the ink from leaking out front between the thin film stacked body 13 and the resist layer 14.

On the other hand, since the viscosity of the second resist when being applied is higher than that of the first resist when being applied, it is possible to increase the height of the second resist layer 114*b* by applying the second resist to the upper surface of the first resist layer 114*a*. By virtue of this, it is possible to make the entire resist layer 114 thicker than a case in which the resist layer 114 is entirely formed only by the first resist. That is, by interposing the thin first resin layer 14*a* between the second resin layer 14*b* and the thin film stacked body 13, it is possible to increase the strength of joining the resin layer 14 and the thin film stacked body 13 and, in the meantime, to increase the degree of freedom of the length of the throttle flow passages 33 formed in the resin layer 14.

Further, in the first modification, the combination of the steps S201 and S202 corresponds to the first resist layer formation step of the present teaching. Further, the combination of the steps S203 and S204 corresponds to the second resist layer formation step of the present teaching.

Further, in the above embodiment, the resin layer 14 is ten times or more as thick as each of the wires 27. However, the resin layer 14 may be lower than ten times as thick as each of the wires 27. In such a case, due to the influence from the thickness of the wires 27, concaves and convexes may be formed along the upper surface of the resin layer 14. However, it is possible not to form any interspace between the resin layer 14 and the lower member 41 by increasing the quantity of adhesive applied to join the resin layer 14 and the lower member 41, and/or pressing the resin layer 14 and the lower member 41 strongly enough against each other, etc.

In the above embodiment, the throttle flow passages 33 are smaller in diameter than the connection flow passages 32, and the throttle flow passages 33 entirely overlap, in planar view, with the connection flow passages 32, respectively. However, without being limited to this, the throttle flow passages 33 may be equal to or smaller than the connection flow passages 32 in diameter, respectively. Further, regardless of the relation of size in diameter between the throttle flow passages 33 and the connection flow passages 32, each of the throttle flow passages 33 may not partially overlap with one of the connection flow passages 32 in planar view.

In the above embodiment, each of the throttle flow passages 33 is arranged to overlap, in planar view, with the end portion of one of the pressure chambers 31 in the longitudinal direction. However, without being limited to this, for example, each of the throttle flow passages 33 may overlap, in planar view, with other portion of one of the pressure chambers 31 than the end portion in the longitudinal direction. Furthermore, without being limited to the elongated shape in planar view, for example, each of the pressure chambers 31 may have a planar shape of square, etc, in planar view.

In the above embodiment, the resin layer 14 is arranged over the flow passage formation substrate 12 formed with the thin film stacked body 13, and the throttle flow passages 33 are formed in the resin layer 14. However, without being limited to this, for example, a member made of a metallic material, silicon or the like may be arranged over the flow passage formation substrate 12 formed with the thin film stacked body 13, and the throttle flow passages 33 may be formed in such portions of that member as to overlap in planar view with the pressure chambers 31 respectively. In such a case, for example, the above member preformed with the throttle flow passages 33 may be joined to the flow passage formation substrate 12 formed with the thin film stacked body 13 so as to arrange the member formed with the throttle flow passages 33 on the flow passage formation substrate 12 formed with the thin film stacked body 13.

In the above embodiment, the resist forming the resist layer 114 is a so-called negative resist of which the unirradiated portions A2 are removable with a developer such as an alkaline aqueous solution or the like. However, without being limited to this, the resist forming the resist layer 114 may be a so-called positive resist of which irradiated portions A1 are removable with the developer. In such a case, in the above step S104, the aforementioned photomask M in use may be provided with the light shielding portions Ma which are located in such portions as not to overlap in planar view with the throttle flow passages 33 and the through holes 34. By virtue of this, such portions of the resist layer 114 as to overlap in planar view with the throttle flow passages 33 and the through holes 34 are formed as the irradiated portions A1. Further, such portions of the resist layer 114 as not to overlap in planar view with the throttle flow passages 33 and the through holes 34 are formed as unirradiated portions A2. Then, the resin layer 14 is formed with the throttle flow passages 33 and the through holes 34 by removing the irradiated portions A1 with the developer in the step S105. In this case, after exposing the resist layer 114 and removing the irradiated portions A1, the resist layer 114 is hardened by heating the resist layer 114. In this case, the irradiated portions A1 correspond to the one portion of the present teaching, while the unirradiated portions A2 correspond to the other portion of the present teaching.

In the above embodiment, after joining the lower member 41 to the upper surface of the resin layer 14, the pressure chambers 31 are formed, the nozzle plate 11 is joined, and then the members 42 and 43 are joined to the lower member 41. However, without being limited to this, for example, formation of the pressure chambers 31 and attachment of the nozzle plate 11 may be carried out after joining the members 41 to 43 to the upper surface of the resin layer 14. In such a case, the reservoir unit 15 is not limited to being formed by the three members 41 to 43. For example, the reservoir unit 15 may be formed by the upper member 43, and one other member including a portion corresponding to the lower member 41 and a portion corresponding to the intermediate member 42. Alternatively, the reservoir unit 15 may be formed by one member having portions corresponding to the members 41 to 43 respectively.

Figure 13A:
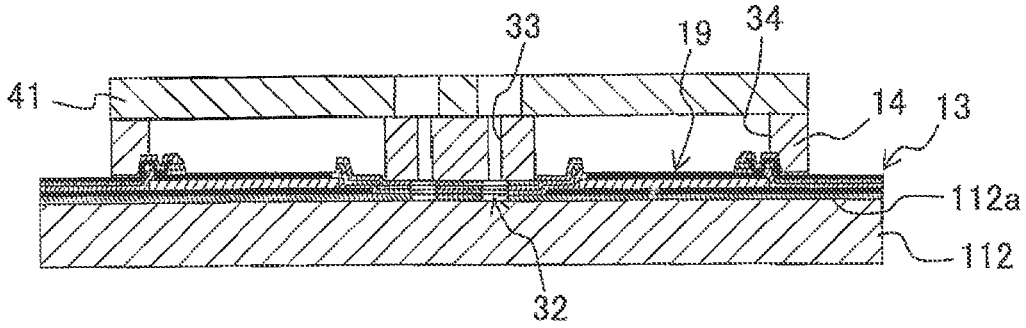
FIG. 13A shows a state in which the lower member is joined to the resin layer in accordance with a second modification.
Figure 13B:
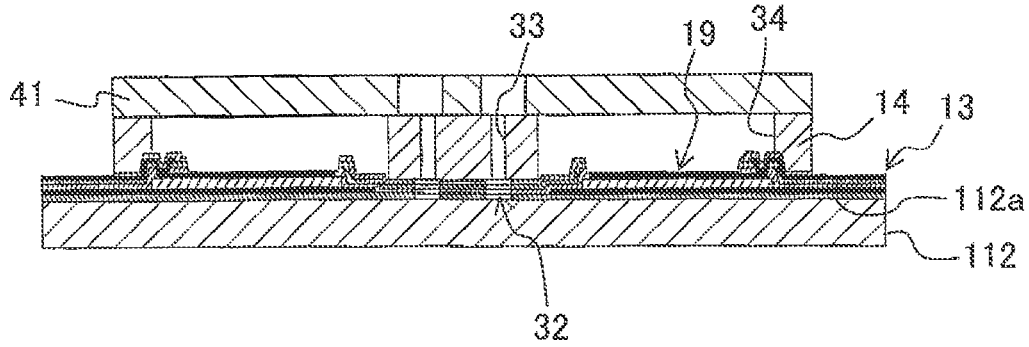
FIG. 13B shows a state in which the silicon substrate has been abraded in the second modification.

In the above embodiment, at the stage of forming the films in the aforementioned S101, the silicon substrate 112 has such a thickness as to correspond to the height of the pressure chambers 31. However, without being limited to this, for example, at the stage of forming the films in the aforementioned S101, the thickness of the silicon substrate 112 may exceed the thickness corresponding to the height of the pressure chambers 31. Then, after forming the thin film stacked body 13 and the resin layer 14 according to the aforementioned S101 through S105 similar to the above embodiment, the lower member 41 may be joined to the upper surface of the resin layer 14 as shown in FIG. 13A in the same manner as S106. Next, the thickness of the silicon substrate 112 may be adjusted to correspond to the height of the pressure chambers 31, as shown in FIG. 13B, by abrading the lower surface of the silicon substrate 112 in a state that the lower member 41 joined to the resin layer 14 is supported.

In the above modification, after the lower member 41 is joined to the upper surface of the resin layer 14, the silicon substrate 112 is abraded in a state that the lower member 41 is supported. Therefore, it is possible to use the lower member 41 as a support member for supporting the silicon substrate 112 when the silicon substrate 112 is abraded. By virtue of this, it is possible to easily abrade the silicon substrate 112. Further, it is possible to prevent damage of the silicon substrate 112.

In the above embodiment, each of the piezoelectric elements 19 is formed by stacking, from below, the ink separation layer 21, common electrode 22, piezoelectric layer 23, and individual electrode 24. However, without being limited to this stacking order, for example, each of the piezoelectric elements 19 may also be formed by stacking, from below, the ink separation layer 21, individual electrode 24, piezoelectric layer 23, and common electrode 22. In this case, the wires 27 may be formed on the upper surface of the ink separation layer 21, while the protective layers 25 and 26 may be formed between the wires 27 and the common electrode 22.

Further, in the above embodiment, the nozzle plate 11 is directly joined to the lower surface of the flow passage formation substrate 12. However, another plate may be interposed between the flow passage formation substrate 12 and the nozzle plate 11. In this case, flow passages may be formed in the plate interposed between the flow passage formation substrate 12 and the nozzle plate 11 to allow the pressure chambers 31 to communicate with the nozzles 13 respectively. By virtue of this, it is possible to extend the length of each of the flow passages from the pressure chambers 31 to the nozzles 13.

Further, the above explanation is made with an example of applying the present teaching to an ink jet head configured to jet ink droplets from nozzles. However, without being limited to this, it is also possible to apply the present teaching to any liquid droplet jetting apparatuses, other than ink jet heads, for jetting liquid droplets other than ink droplets.

What is claimed is:

1. A liquid droplet jetting apparatus comprising:

a nozzle plate formed with a nozzle;

a first flow passage formation body stacked on the nozzle plate, formed with a liquid flow passage including a pressure chamber configured to communicate with the nozzle, and extending in a predetermined planar direction;

a piezoelectric element arranged on a surface of the first flow passage formation body on a side opposite to the nozzle plate, and configured to apply a pressure to a liquid in the pressure chamber;

a wire arranged on the side opposite to the nozzle plate with respect to the first flow passage formation body, and connected to the piezoelectric element; and a second flow passage formation body comprising:

a resin layer stacked on the side opposite to the nozzle plate with respect to the first flow passage formation body, and having a thickness which is ten times or more of a thickness of the wire; and a storing chamber formation body stacked on a surface of the resin layer on a side opposite to the first flow passage formation body, and formed with a liquid storing chamber configured to store the liquid to be supplied to the pressure chamber;

wherein the resin layer is formed with:

a throttle flow passage arranged between the pressure chamber and the liquid storing chamber and configured to connect the pressure chamber and the liquid storing chamber and to restrict an amount of the liquid flowing from the liquid storing chamber into the pressure chamber;

wherein, with respect to a direction orthogonal to the predetermined planar direction, the nozzle, the pressure chamber, the throttle flow passage, and the liquid storing chamber are arranged in this order; and wherein the throttle flow passage overlaps with the pressure chamber, when viewed from the direction orthogonal to the predetermined planar direction.

2. The liquid droplet jetting apparatus according to claim 1;

wherein the pressure chamber is formed as a plurality of pressure chambers in the first flow passage formation body;

wherein each of the plurality of pressure chambers is elongated in one predetermined direction along the predetermined planar direction, and the plurality of pressure chambers are aligned in a direction orthogonal to the one predetermined direction;

wherein the throttle flow passage is formed as a plurality of throttle flow passages corresponding to the plurality of pressure chambers respectively; and wherein, when viewed from the direction orthogonal to the predetermined planar direction, each of the plurality of throttle flow passages overlaps with one end portion, in the one predetermined direction, of the corresponding pressure chamber.

3. The liquid droplet jetting apparatus according to claim 1;

wherein the pressure chamber is formed as a plurality of pressure chambers in the first flow passage formation body;

wherein the piezoelectric element is provided as a plurality of piezoelectric elements corresponding to the plurality of pressure chambers respectively;

wherein a plurality of layers are formed as films stacked each other on the surface of the first flow passage formation body on the side opposite to the nozzle plate;

wherein the plurality of layers include:

a piezoelectric layer made of a piezoelectric material and constituting the plurality of piezoelectric elements arranged to overlap with the plurality of pressure chambers;

a plurality of electrodes arranged to overlap with the plurality of pressure chambers and constituting the plurality of piezoelectric elements; and a plurality of wires connected with the plurality of electrodes respectively;

wherein a plurality of penetration portions are formed at portions of the resin layer overlapping with the plurality of piezoelectric elements when viewed from the direction orthogonal to the predetermined planar direction;

wherein the plurality of wires extend respectively up to positions not overlapping with the plurality of penetration portions when viewed from the direction orthogonal to the predetermined planar direction; and wherein the resin layer is formed by hardening a liquid resist containing a photosensitive resin.

4. The liquid droplet jetting apparatus according to claim 3;

wherein the resin layer includes:

a first resin layer formed by hardening a first resist containing the photosensitive resin, and arranged on the surface, of the first flow passage formation body, on which the plurality of layers are formed and which is on the side opposite to the nozzle plate; and a second resin layer formed by hardening a second resist containing the photosensitive resin, and arranged on a surface of the first resin layer on a side opposite to the first flow passage formation body; and wherein the first resist before being hardened has a lower viscosity than the second resist before being hardened.

5. The liquid droplet jetting apparatus according to claim 1;

wherein a plurality of layers are formed as films to stack each other on a surface of the first flow passage formation body on the side opposite to the nozzle plate;

wherein a portion of the plurality of layers forms the piezoelectric element;

wherein a subset of the plurality of layers extends up to a position overlapping with the throttle flow passage;

wherein a connection flow passage configured to connect the pressure chamber and the throttle flow passage is formed at a portion, of the subset of the plurality of layers, overlapping with the throttle flow passage; and wherein, when viewed from the direction orthogonal to the predetermined planar direction, the connection flow passage has a cross-sectional area greater than a cross-sectional area of the throttle flow passage and an entire cross section of the throttle flow passage overlaps with a cross section of the connection flow passage.

6. The liquid droplet jetting apparatus according to claim 1;

wherein the piezoelectric element includes a piezoelectric layer made of a piezoelectric material;

wherein the resin layer is further formed with a through hole at a position overlapping with the piezoelectric element when viewed from the direction orthogonal to the predetermined plane; and wherein, when viewed from the direction orthogonal to the predetermined plane, an outer periphery of the piezoelectric layer is surrounded by an inner periphery of the through hole.

7. The liquid droplet jetting apparatus according to claim 1;

wherein the pressure chamber is formed as a plurality of pressure chambers in the first flow passage formation body;

wherein each of the plurality of pressure chamber is elongated in one predetermined direction along the predetermined planar direction, and the plurality of pressure chambers form first and second pressure chamber rows adjacent to each other in the one predetermined direction;

wherein the throttle flow passage is formed as a plurality of throttle flow passages corresponding to the plurality of pressure chambers respectively;

wherein the plurality of throttle flow passages form first and second throttle flow passage rows adjacent to each other in the one predetermined direction and corresponding to the first and second pressure chamber rows respectively;

wherein, when viewed from the direction orthogonal to the predetermined planar direction, each of the throttle flow passages included in the first throttle flow passage row overlaps with one of the pressure chambers included in the first pressure chamber row at one end portion near to the second pressure chamber row in the one predetermined direction; and wherein, when viewed from the direction orthogonal to the predetermined planar direction, each of the throttle flow passages included in the second throttle flow passage row overlaps with one of the pressure chambers included in the second pressure chamber row at one end portion near to the first pressure chamber row in the one predetermined direction.

* * * * *